US010081886B2

(12) United States Patent
Corbellini

(10) Patent No.: US 10,081,886 B2
(45) Date of Patent: Sep. 25, 2018

(54) TEXTURING DEVICE

(71) Applicant: IROPA AG, Baar (CH)

(72) Inventor: Ermete Corbellini, Cosio Valtellino (IT)

(73) Assignee: IROPA AG, Baar (CH)

( * ) Notice: Subject to any disclaimer, the term of this patent is extended or adjusted under 35 U.S.C. 154(b) by 0 days.

(21) Appl. No.: 15/327,016

(22) PCT Filed: Jul. 20, 2015

(86) PCT No.: PCT/IB2015/055482
§ 371 (c)(1),
(2) Date: Jan. 17, 2017

(87) PCT Pub. No.: WO2016/009414
PCT Pub. Date: Jan. 21, 2016

(65) Prior Publication Data

US 2017/0175300 A1 Jun. 22, 2017

(30) Foreign Application Priority Data

Jul. 18, 2014 (BE) ..... 2014/0565

(51) Int. Cl.
*D02G 1/12* (2006.01)
*D02G 1/16* (2006.01)
*D02G 1/20* (2006.01)

(52) U.S. Cl.
CPC ..... *D02G 1/122* (2013.01); *D02G 1/161* (2013.01); *D02G 1/205* (2013.01)

(58) Field of Classification Search
CPC D02G 1/12; D02G 1/127; D02G 1/16; D02G 1/161; D02G 1/006; D02G 1/122; D02G 1/125; D02G 1/162; D02G 1/205; D02G 1/164; D02J 1/08; D02J 1/02
USPC ..... 28/256, 257, 263, 266, 221, 254, 255
See application file for complete search history.

(56) References Cited

U.S. PATENT DOCUMENTS 3,816,887 A 6/1974 Smith et al.
4,118,843 A 10/1978 Schippers et al.
4,296,535 A * 10/1981 Li ..... D02G 1/12 28/257
4,301,102 A * 11/1981 Fernstrom ..... D01F 6/60 264/151
6,079,086 A * 6/2000 Wirz ..... D02G 1/0266 28/240

(Continued)

FOREIGN PATENT DOCUMENTS

EP 0310890 B1 * 12/1991 ..... D02G 1/122

OTHER PUBLICATIONS

International Search Report dated Oct. 21, 2015.

*Primary Examiner* — Amy Vanatta
(74) *Attorney, Agent, or Firm* — Symbus Law Group, LLC; Clifford D. Hyra

(57) ABSTRACT

A device for texturing a thread-like plastic material in order to form a crimped textile yarn, comprising a texturing unit having at least two texturing channels for forming respective yarn plugs, wherein the texturing channels extend in the texturing unit along respective axes which converge in the direction of the discharge openings. The device preferably also comprises a discharge channel in order to guide the yarn plugs from the texturing channels to a moving conveying surface in a converging manner.

15 Claims, 4 Drawing Sheets

(56) References Cited

U.S. PATENT DOCUMENTS

| | | | | |
|---|---|---|---|---|
| 6,085,395 | A * | 7/2000 | Weiss | D02G 1/12 28/221 |
| 6,119,320 | A | 9/2000 | Weiss | |
| 6,378,180 | B2 * | 4/2002 | Maranca | D01D 5/22 28/221 |
| 7,712,197 | B2 * | 5/2010 | Stundl | D02G 1/12 28/221 |
| 2004/0031134 | A1 * | 2/2004 | Koslowski | D02G 1/122 28/263 |
| 2005/0242461 | A1 * | 11/2005 | Stundl | D02G 1/12 264/168 |

* cited by examiner

TEXTURING DEVICE

This application claims the benefit of Belgian patent applications No. 2014/0565, filed Jul. 18, 2014, which is hereby incorporated by reference in its entirety.

FIELD OF THE INVENTION

The present invention relates to a device for texturing a thread-like plastic material in order to form a crimped textile yarn, comprising a texturing unit having at least two texturing channels which are provided to displace thread-like plastic material in the texturing channel to a discharge opening and transform it into a yarn plug in the texturing channel, respectively.

BACKGROUND

During the production of synthetic yarns, separate filaments are formed from a thermoplastic, such as e.g. polypropylene, polyester or polyamide. This is achieved using an extrusion process. A number of these filaments are combined to form a so-called multifilament yarn. It is known to improve the properties of a multifilament yarn by texturation in order to improve its suitability for certain applications. This is done, for example by bringing a heated gaseous medium, such as hot air, near the filaments in a texturing channel at high speed. As a result thereof, the filaments are moved into the texturing channel and are deformed in a part of the texturing channel that is situated further away. Subsequently, the yarn is set, thus producing a crimped yarn. As a result hereof, the yarn is more voluminous and acquires a better covering capacity which is certainly advantageous for synthetic yarns which are used to weave or to tuft carpets.

Known texturing devices, such as the device described in U.S. Pat. No. 6,309,388 B 1, comprise a texturing unit in which two texturing channels are provided parallel to each other. A respective multifilament yarn is introduced into each channel via an inlet opening in the channel. An air inlet is provided in each channel via which hot air is blown into the texturing duct at great speed. This air has a temperature which is sufficiently high to bring the plastic material up to a processing temperature at which the plastic is weak and deforms easily. In a well-defined zone, the texturing channels are made wider and provided with outlet openings via which air can escape. The yarn is carried along by the hot air into the texturing channels. In the wider zones of these channels, the speed of the air and the yarn drops significantly, as a result of which the yarn is compressed to form a yarn plug, and is moved in the channel as a yarn plug and eventually leaves the texturing channel via a discharge opening. Subsequently, the two yarn plugs are placed on the lateral surface of a slowly rotating cooling drum in order to cool. The deformations of the filaments are thus set. The textured yarn is then lead away from the surface of the cooling drum and subjected to any additional treatments and is finally wound onto bobbins as a crimped textile yarn.

The properties of such a textured yarn are inter alia determined by the circumstances in which the yarn cools after having completed the texturing process. In the known texturing devices, the yarn plugs are taken to a cooling surface via relatively long separate channels after leaving the two adjacent texturing channels. As a result thereof, the circumstances in which these yarn plugs cool on their path between the texturing channel and the cooling surface may differ to the degree that the simultaneously textured yarns have mutually different properties.

SUMMARY

It is an object of the present invention to overcome the drawbacks of these known texturing devices by providing a texturing device by means of which two or more thread-like plastic materials can be textured simultaneously in the same texturing unit, and by means of which the risk of mutual differences between these textured synthetic yarns is significantly reduced.

This object is achieved by providing a device for texturing a thread-like plastic material to form a crimped textile yarn, comprising a texturing unit having at least two texturing channels which are provided to displace a thread-like plastic material in the texturing channel and transform it into a yarn plug, respectively, wherein the texturing channels in the texturing unit extend along respective axes which converge in the direction of movement of the plastic material.

On the side where the plastic material is supplied, sufficient intermediate space has to be provided between the texturing channels for the inlet channels via which a gaseous medium is blown into the texturing channels. On this side, the texturing channels thus have to be relatively far apart. According to the present invention, however, the distance between the texturing channels on the side of the discharge opening is reduced, while retaining the required intermediate distance on the supply side, by making the texturing channels converge in a rectilinear manner in the direction of the discharge openings, the direction in which the plastic material is displaced in the texturing channels. Since the discharge openings of the adjacent texturing channels are consequently much closer to one another, the various yarn plugs can be more easily moved towards one another and across a shorter path. In this way, the yarn plugs can already be brought together in a common discharge channel in which they meet, preferably lie against one another, before reaching the conveying surface. As a result thereof, the various yarn plugs are subjected to very similar cooling circumstances, as a result of which the risk of mutual differences between the simultaneously textured yarns is significantly smaller than during texturing using the known texturing units.

During preparation of the activation of the texturing device, the texturing channels are opened and a multifilament yarn is introduced in each opened texturing channel. This is usually carried out by an operator who picks up the end of a supplied multifilament yarn (e.g. with the aid of a portable suction device) and places this yarn in the open channel in such a way that it extends along the entire length thereof. If the texturing channels run in a bend or consist of two or more channel sections which are joined to each other forming an angle, the operator has to follow this bent or angled path when introducing the yarn. Thus, the introduction of the yarn is slowed down and the risk of a yarn not being introduced correctly is also increased, as a result of which the introducing action has to be repeated.

Due to the rectilinear converging texturing channels, this drawback is overcome. Every yarn can easily be introduced in one smooth rectilinear movement, resulting in a quicker and more efficient introduction.

Preferably, each texturing channel is also provided with a discharge channel which is connected to the texturing channel and in which the yarn plug leaving the texturing duct can be displaced further. At least along part of its length, each discharge channel preferably also extends in line with the texturing channel to which it is connected. The various texturing channels also converge in the direction of displacement of the yarn plugs, either along part of their length or along their entire length.

In this case, the discharge channels preferably also have a course which is such that the perpendicular projections of their axes converge in a rectilinear manner along their entire length in a plane of projection which is parallel to the plane in which the axes of the texturing channels are situated, while the perpendicular projection of the axis of each texturing channel and the perpendicular projection on the same plane of projection of the axis of the connected discharge channel are substantially in line with each other. In this way, a rectilinear convergence of the various texturing channels and of the respective connected discharge channels is achieved.

The embodiment described in the previous paragraph is ideal for introducing yarn material in a quick and efficient manner, it being possible to introduce the yarn material in one rectilinear movement along the entire rectilinear path of a texturing channel and the associated discharge channel.

The discharge channels may remain completely or partly separated up to their respective outlet or may converge in a common end section of the channel.

Obviously, the intermediate distance ($T_2$) between two converging axes on the side of the discharge openings of the texturing channels is smaller than the intermediate distance ($T_1$) between these axes on the side of the inlet openings. The ratio ($T_2/T_1$) between this intermediate distance ($T_2$) on the discharge side and this intermediate distance ($T_1$) on the supply side is always less than 1. Preferably, this ratio is between 0.30 and 0.90. A very preferred embodiment has a ratio of approximately 0.50.

The texturing channels extend, for example, along converging axes (a),(b),(c) between which a convergence angle ($\alpha$) is formed of between 1° and 30°. Preferably, this angle is approximately 4°.

In a preferred embodiment, the texturing device comprises two single-piece shells having a respective contact surface and the texturing channels are partly formed in the one contact surface and partly in the other contact surface, with a part of the texturing channels which is cut in the longitudinal direction of the texturing channels being formed in the contact surface of the one shell, while the remaining part of the texturing channels is formed in the contact surface of the other shell, so that the shells, when placed against each other with their contact surface, together form a body in which the converging texturing channels are provided.

In this case, the texturing channels may be formed in the contact surface of the one shell as open channels, while the contact surface of the other shell forms a covering wall for closing off these open channels. This covering wall may be of a substantially flat design.

In a preferred embodiment, the texturing device comprises two single-piece shells, each having a contact surface in which in each case the half of the converging channels which is cut in the longitudinal direction is formed, so that the shells together form a body when their contact surfaces are placed against each other in which the converging texturing channels are provided.

The texturing channels preferably have the same transverse dimension(s) over their entire length. With a cylindrical texturing channel, the transverse dimension is understood to mean the diameter of the channel. The texturing channels may also have a cross section which differs from a round shape, such as for example a square or rectangular cross section.

In a particular embodiment, the transverse dimension of the texturing channels changes one or more times. Preferably, the texturing channels are configured to have at least one stepped increase in a transverse dimension in the direction of movement of the yarn material.

The shape of the cross section of the texturing channels may also change one or more times, preferably in a stepped manner, in which case, for example, a cross section which is initially circular or oval, changes into a different cross section of a square or rectangular shape in a stepped manner. For the sake of clarity, the terms 'initially' and 'different' refer to the shape which the cross section has before the change in shape and after the change in shape, viewed in the direction of movement of the yarn material. Preferably, the changes in shape are thus that the channel walls of the changed shape are not inside the space which is surrounded by the extension of the channel walls of the original shape. This prevents the yarn material from coming into contact with inwardly protruding edges in the texturing channel while moving through the texturing channel, which protruding edges may hamper the smooth passage of the yarn material and may thus adversely affect the properties of the yarn plug and the crimped yarn. The texturing channels may have one or more changes of transverse dimension as well as one or more changes in the shape of the cross section.

In a preferred embodiment of the texturing device according to the present invention, the texturing unit comprises at least three converging texturing channels. These texturing channels preferably extend along respective axes which converge towards a common fictitious convergence point.

In order to ensure that the yarn plugs which leave the various texturing channels produce a crimped yarn having exactly the same properties, it is also important that the yarn plugs in the various texturing channels are treated in an identical manner and thus also that the texturing channels are of exactly the same length. Here, the length of a texturing channel is understood to mean the length between the location where the gaseous medium is introduced into the texturing channel and the discharge opening of the texturing channel.

To this end, it is sometimes necessary to take particular measures. For example, in the case of a texturing unit which is provided with three texturing channels, the inlet channels for the gaseous medium of which are situated in a straight line, it should be taken into account that the angle at which the texturing channels extend with respect to this line is not the same for all texturing channels. For example, the central texturing channel will extend at right angles to this line, while the two other texturing channels, which are situated to the left and right of this central texturing channel, respectively, will form a small angle with respect to this perpendicular direction. If the discharge openings would also be situated on one straight line which runs parallel to the former line, then the central texturing channel would have a smaller length than the two other texturing channels. In order to produce texturing channels of identical length, the discharge openings and the inlet channels of these texturing channels cannot be on parallel straight lines. To this end, modifications to the mutual positions of the inlet openings and/or to the mutual positions of the discharge openings of the texturing channels may be effected. The discharge openings will coincide, for example, with a straight end edge of the texturing unit, while the inlet channels are situated on a line which has a curved trajectory.

With a texturing channel, the channel length between the inlet channels for the gaseous medium and the outlet openings via which this gaseous medium can escape (into the wider channel portion, usually referred to as 'stuffer box') is also important for the properties of the crimped yarn. Preferably, this channel length is also identical for the various texturing channels of the texturing device according to the present invention.

In a particular embodiment, the texturing device comprises a channel portion with outlet openings for the gaseous medium in each texturing channel, which channel portion is designed as a separate removable part ('stuffer box'). Preferably, this channel portion is designed to have a larger cross section than the portion of the texturing channel which is situated upstream of this removable part, viewed in the direction of movement of the yarn material.

The texturing device may also be provided with one or more discharge channels in order to guide the yarn plugs further after they have left their respective texturing channels. The or each discharge channel preferably comprises a guiding surface, at least part of which has a roughness which is different from that of the surface which the same yarn material contacts in the texturing channels. After all, this roughness may affect certain properties of the yarn plugs, such as for example the density. Preferably, the roughness of said guiding surface is greater than the roughness of the inside surface of the texturing channels.

In a particular embodiment, the texturing device comprises at least two replaceable discharge units which comprise one or more discharge channels, respectively. The guiding surfaces of the discharge channels of the various discharge units have a mutually different roughness. The texturing device is provided to optionally accommodate one of these discharge units as a removable part in the texturing device.

In this way, it is possible, by replacing the discharge unit accommodated in the texturing device by another discharge unit, to adjust the roughness of the guiding surfaces to specific circumstances or wishes, for example to influence the properties of the yarn plugs and/or to adjust the texturing device to the properties of a different yarn material.

In the above paragraphs, the term 'roughness' may be replaced by 'frictional resistance with respect to a certain yarn material'. This yarn material may, for example, be polyamide-6, polypropylene or polyester.

The discharge channels also preferably have the same transverse dimension(s) over their entire length. In the case of a cylindrical discharge channel, the diameter is the transverse dimension. The discharge channels may also have a cross section which differs from a round one, such as for example a square or rectangular cross section. In a particular embodiment, the discharge channels are configured to have one or more changes of transverse dimension, preferably comprising, in the direction of movement of the yarn material, at least one stepped increase in transverse dimension.

The shape of the cross section of the discharge channels may also change one or more times, preferably also in a stepped manner. Thus, it is possible, for example, for a cross section which is initially circular or oval to change in to a different cross section having a square or rectangular shape in a stepped manner in the direction of movement of the yarn material. As is the case with the texturing channels and for the same abovementioned reason, the changes in shape are preferably also such that the channel walls of the changed shape are not inside the space which is enclosed by the extension of the channel walls of the original shape. The discharge channels may have one or more changes of transverse dimension as well as one or more changes in the shape of the cross section.

In another preferred embodiment, the texturing device according to the present invention comprises a movable conveying surface, the device is provided to place the yarn plugs leaving the texturing channels onto the moving conveying surface, and the device comprises a discharge channel which is provided to lead the yarn plugs from the texturing channels towards the conveying surface in a converging manner.

The yarn plugs form a group in which the mutual positions of the yarn plugs are already fixed before they reach the conveying surface. They are moved as a group and placed on the conveying surface and are in this case subjected to identical cooling circumstances.

Preferably, these converging yarn plugs are situated next to each other at a small intermediate distance apart. In a most preferred embodiment, the device is provided to lead the yarn plugs to the conveying surface over at least a part of the path to the conveying surface in such a way that they rest against each other, in other words substantially contacting each other.

The yarn plugs are placed on the moving conveying surface in order to allow them to cool in a uniform manner. To this end, it is possible, for example, to provide openings in the conveying surface which form passages through the conveying surface while the device also comprises means, such as for example a suction device and/or a blowing device, for creating a stream of air through these openings. This results in a uniform stream of air through the filaments of the yarn plugs which are situated on the conveying surface, which significantly contributes to their uniform cooling. In addition, this stream of air also pushes the yarn plugs against the conveying surface, as a result of which their relative position with respect to the moving conveying surface is ensured. An underpressure is preferably created below the conveying surface here, as a result of which ambient air is sucked from the space above the surface to the space below the surface via these passages.

The texturing device preferably comprises a rotatable cooling drum comprising a cylindrical lateral surface which forms said conveying surface. In a preferred embodiment of the texturing device, this cylindrical lateral surface is designed to have a flat and uninterrupted surface so that the converging yarn plugs can be placed on the lateral surface so that they rest against each other and are not separated from each other. The yarn plugs may bear against each other on the lateral surface. Due to the fact that the yarn plugs are not separated and are not, for example, situated in separate grooves, the circumstances under which they cool are identical.

In another preferred embodiment, the device is provided to lead the converging yarn plugs away from the cylindrical lateral surface after the converging yarn plugs have completed at least one entire revolution, preferably at least 1.3 revolutions, on the lateral surface.

It is, for example, also possible to choose to lead the yarn plugs away from the lateral surface after three revolutions or after four revolutions. The yarn plugs are not necessarily on the cooling drum for an integer number of revolutions and may be lead away from the conveying surface at any location before the last revolution is completed, for example after 1¾ or after 2½ revolutions. The number of revolutions is determined on the basis of the speed of rotation of the cooling drum and the time required to cool the yarn plugs sufficiently.

During each revolution, the yarn plugs originating from the various texturing channels run in a group next to each other. In this case, the yarn plugs always maintain the same order in the group. A first part of these converging yarn plugs, having a length which substantially corresponds to the periphery of the cylinder surface, performs a first revolution, a second part performs a second revolution, a third part performs a third revolution, etc. Having performed a complete first revolution, the converging second parts of the yarn plugs are placed next to their converging first parts which perform the first revolution on the lateral surface. The converging third parts which perform the third revolution run next to the converging second parts performing the second revolution, etc. Preferably, no separation (by grooves and the like) is provided between the parts of the yarn plugs running next to each other and belonging to successive revolutions on the lateral surface, so that the yarn plugs of successive revolutions situated next to one another can also lie next to one another at a small intermediate distance. Preferably, these parts also bear against each other.

In a particular embodiment, the texturing device also comprises guide means to place the converging parts of yarn plugs of successive revolutions next to each other on the lateral surface.

Preferably, the abovementioned discharge channel comprises an end section which comprises a guiding surface which is situated above the conveying surface and which is laterally delimited by at least one channel wall which protrudes above the support surface. A channel wall may then comprise a side which faces the lateral surface and is provided to guide, at the start of a second revolution, the converging yarn plugs onto the lateral surface next to the parts of the converging yarn plugs which are performing the first revolution.

Such guiding means may obviously also be provided to guide the converging yarn plugs at the start of each subsequent revolution next to the parts of the converging yarn plugs which are performing the previous revolution.

The guide means are preferably provided in the form of a guide element which is situated above the lateral surface and comprises a guide wall which extends obliquely from a location in the vicinity of the one side edge of the cylinder surface to the other side edge in order to guide, at the start of the second revolution, the converging yarn plugs onto the lateral surface next to the parts of the converging yarn plugs which are performing the first revolution.

The oblique guide wall makes an angle ($\beta$) with respect to the plane in which the one side edge of the lateral surface is situated which is preferably between 2.5° and 90°, more preferably between 4° and 15°, and most preferably approximately 8°.

Preferably, the oblique guide wall extends obliquely from a location in the vicinity of the first side edge of the cylinder surface to the second side edge up to a distance from this first side edge which approximately corresponds to the width of a zone which is provided on the lateral surface from this first side edge for the converging yarn plugs. This width preferably substantially corresponds to the width which the converging yarn plugs have when they substantially rest against each other.

The discharge channel comprises, for example, an outlet which is directed in such a manner that the yarn plugs leave the discharge channel in a direction which substantially corresponds with the direction in which the lateral surface below this outlet is moved. The speed of rotation of the cooling drum is then preferably fixed in such a manner that the displacement speed of the lateral surface moving below this outlet is substantially identical to the speed at which the yarn plugs leave the discharge channel. Ideally, the outlet of the discharge channel is then provided in such a way that the yarn plugs are able to leave the discharge channel in a straight line and are deposited on said zone of the lateral surface without bending. The outlet of the discharge channel is then also preferably arranged vertically above said zone.

The guide element and the discharge channel may be connected to each other or form part of the same component.

BRIEF DESCRIPTION OF THE DRAWINGS

In order to further explain the features of the invention a detailed description of a possible embodiment of a texturing device according to the present invention is given below. It will be clear that this is only an example of the many embodiments which are possible within the scope of the invention and that this description can by no means be seen as a limitation of the scope of protection. Reference numerals are used in this detailed description to the attached figures, in which.

DETAILED DESCRIPTION OF EMBODIMENTS

Figure 1:
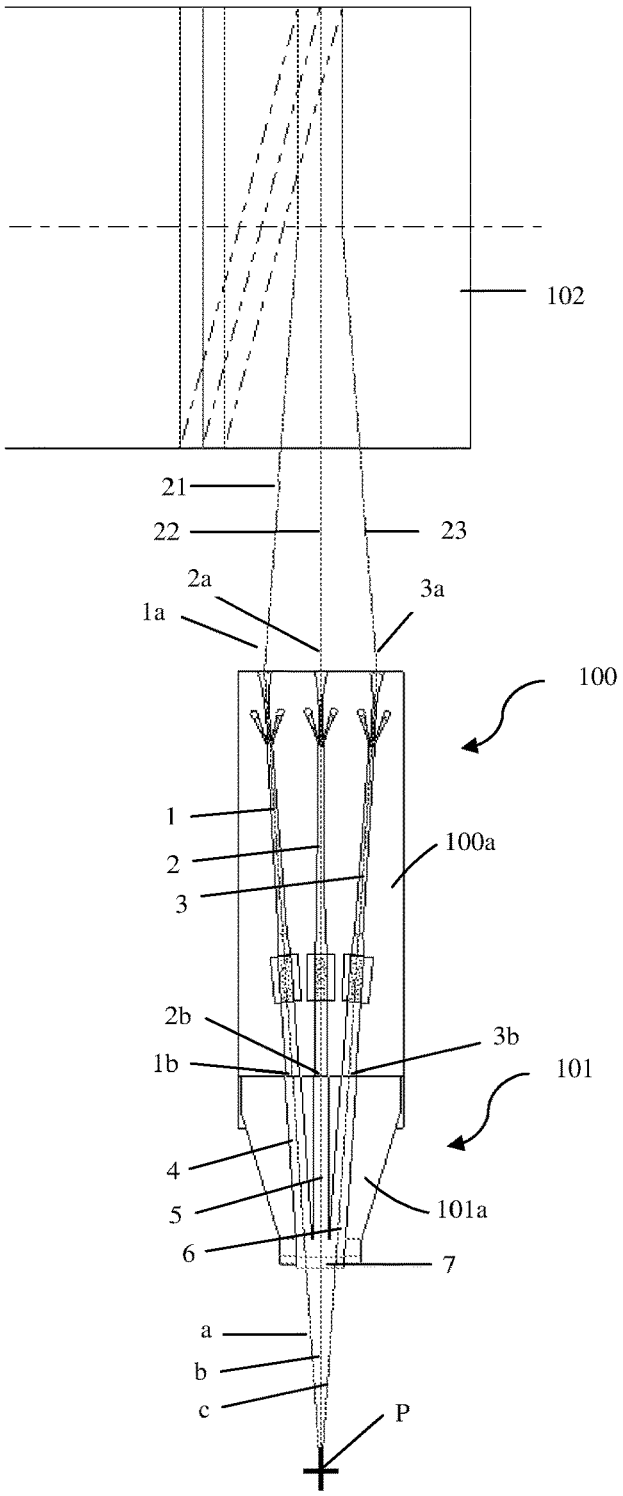
FIG. 1 shows a diagrammatic representation of a part of a texturing device according to the present invention.

The texturing device illustrated in the figures comprises a texturing unit (100) comprising three rectilinear texturing channels (1),(2),(3) with respective longitudinal axes (a),(b),(c) which converge in a fictitious convergence point (P). The angle ($\alpha$) between the axis (b) of the central texturing channel (2) and each of the axes (a),(c) of the left-hand (1) and right-hand texturing channel (3) is approximately 4° (see FIG. 2).

The texturing channels (1),(2),(3) are formed inside the texturing unit (100), with the texturing unit (100) consisting of two identical parts (100*a*),(100*b*) which each comprise a surface in which three converging semi-cylindrical open channels are formed. For the sake of simplicity, these half-channels are denoted by the same reference numerals (1),(2),(3) as the fully closed texturing channels. By placing these two parts (100*a*),(100*b*) against each other by said surfaces in a fitted manner, a unit (100) is produced in which three closed cylindrical texturing channels (1),(2),(3) are formed. These texturing channels (1),(2),(3) may also have a non-round cross section, such as for example a square cross section.

Figure 2:
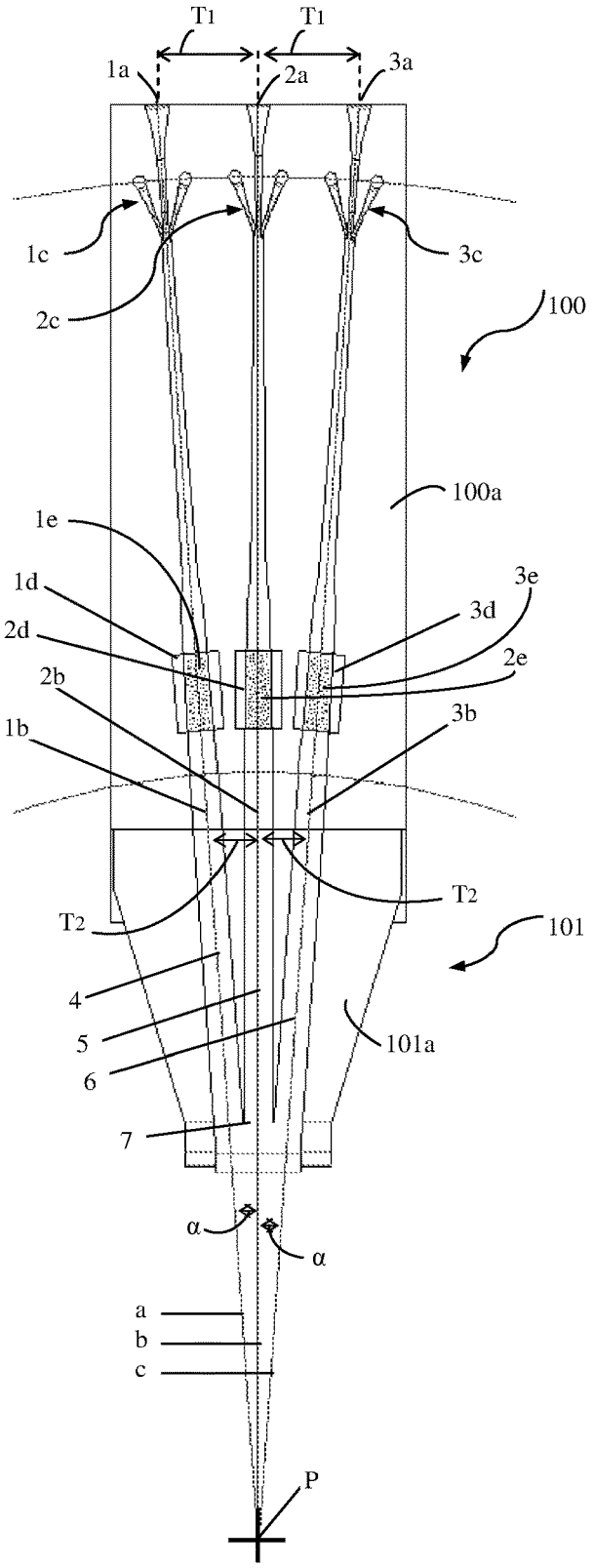
FIG. 2 shows an enlarged diagrammatic representation of the texturing unit and a part of the adjoining discharge unit from FIG. 1.

FIGS. 1 and 2 show only one of these two parts of the texturing unit so that the surface with the semi-cylindrical open channels (1),(2),(3) is visible.

At one end, each texturing channel (1),(2),(3) comprises an inlet opening (1*a*),(2*a*),(3*a*) via which the respective multifilament yarns (21),(22),(23) are introduced into the texturing channels (1),(2),(3). These yarns (21),(22),(23) come from a heated feed roller (102). At the other end, each texturing duct (1),(2),(3) also comprises a discharge opening (1*b*),(2*b*),(3*b*). In the vicinity of the inlet opening (1*a*),(2*a*),(3*a*), each channel (1),(2),(3) comprises a respective air intake (1*c*),(2*c*),(3*c*) consisting of two inlet channels which are connected at opposite sides of the texturing channel (1),(2),(3) in a V shape and are provided to blow hot air at high speed into the texturing channel. This stream of air takes the yarn to the temperature which is required to be able to deform the plastic material and carries the yarn further in the texturing channels (1),(2),(3).

In a first typical application, the yarn to be produced is a polyamide-6 yarn, with a yarn titre of 1200 dtex, of 68 filaments. The speed of the yarn at the inlet channel may be 3500 meters per minute. The speed of the yarn plug is then typically approximately 50 meters per minute. Associated values for the compressed air pressure at the inlet of the inlet channels are then approximately 7.2 bar and for the temperature approximately 175° C.

In a second application, the yarn to be produced is a polypropylene yarn, with a yarn titre of 1100 dtex, of 144 filaments. The speed of the yarn at the inlet channel may be 3800 meters per minute. The speed of the yarn plug is then typically approximately 55 meters per minute. Associated values for the compressed air pressure at the inlet of the inlet channels are then approximately 8.3 bar and for the temperature approximately 153° C.

In a third application, the yarn to be produced is a polypropylene yarn, with a yarn titre of 3000 dtex, of 144 filaments. The speed of the yarn at the inlet channel may be 2440 meters per minute. The speed of the yarn plug is then typically approximately 77 meters per minute. Associated values for the pressurized air pressure at the inlet of the inlet channels are then approximately 8 bar and for the temperature approximately 153° C.

Further downstream, each texturing duct (1),(2),(3) has a widened section resulting in a kind of chamber (1*d*),(2*d*),(3*d*) being formed which is generally referred to by the English term 'stuffer box'. The walls of these chambers (1*d*),(2*d*),(3*d*) are provided with discharge openings (1*e*),(2*e*),(3*e*) via which some of the hot air which has been introduced can escape. As a result thereof, a sudden drop in air pressure occurs in these chambers, resulting in the air speed and the speed of the multifilament yarn which is carried along by the former suddenly decreasing and the yarn being compressed to form a yarn plug (11),(12),(13), as a result of which the filaments are subjected to deformations. These deformations cause an increase in volume which will ultimately produce a crimped textile yarn.

On the supply side, there is a relatively large intermediate distance ($T_1$) between the axes (a),(b),(c) of the converging texturing channels (see FIG. 2), because there has to be sufficient space between every two adjacent texturing channels for the inlet channels of their respective air inlets (1*c*),(2*c*),(3*c*). On the discharge side, the intermediate distance ($T_2$) between the axes (a),(b),(c) is much smaller. The ratio ($T_2/T_1$) between this intermediate distance ($T_2$) on the discharge side and this intermediate distance ($T_1$) on the supply side is approximately 0.5.

The length of the texturing channels between the inlet channels of the air inlets (1*c*),(2*c*),(3*c*) and the discharge openings (1*b*),(2*b*),(3*b*) is identical for the various texturing channels (1),(2),(3). The channel length between these air inlets and the abovementioned discharge openings (1*e*),(2*e*),(3*e*) is also identical in the various texturing channels (1),(2),(3).

The textured yarns leave the texturing channels (1),(2),(3) as yarn plugs (11),(12),(13) via the discharge openings (1*b*),(2*b*),(3*b*). The yarn plugs are only illustrated in FIGS. 3 and 4.

A discharge unit (101) provided with three converging discharge channels (4),(5),(6) is attached to the underside of the texturing unit (100). Each discharge channel is connected to a respective texturing channel (1),(2),(3) and extends in line with it along the same axes (a),(b),(c). In an end section of the discharge unit (101), the three discharge channels (4),(5),(6) end in one common discharge channel (7).

Figure 4:
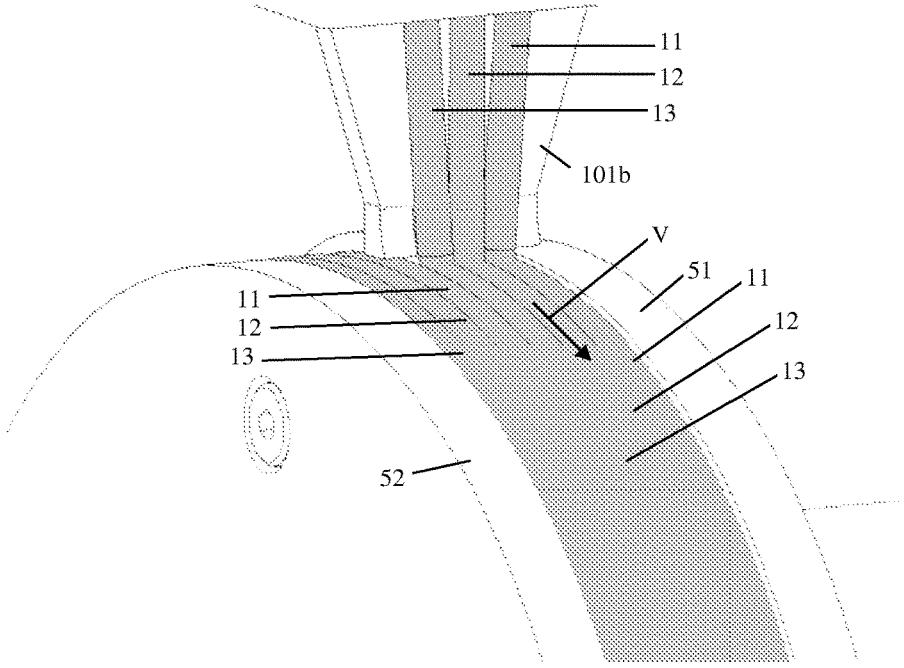
FIG. 4 shows another perspective view of the discharge unit, the guide element and the cooling drum with yarn plugs from FIG. 3, with a covering part of the discharge unit removed.
Figure 5:
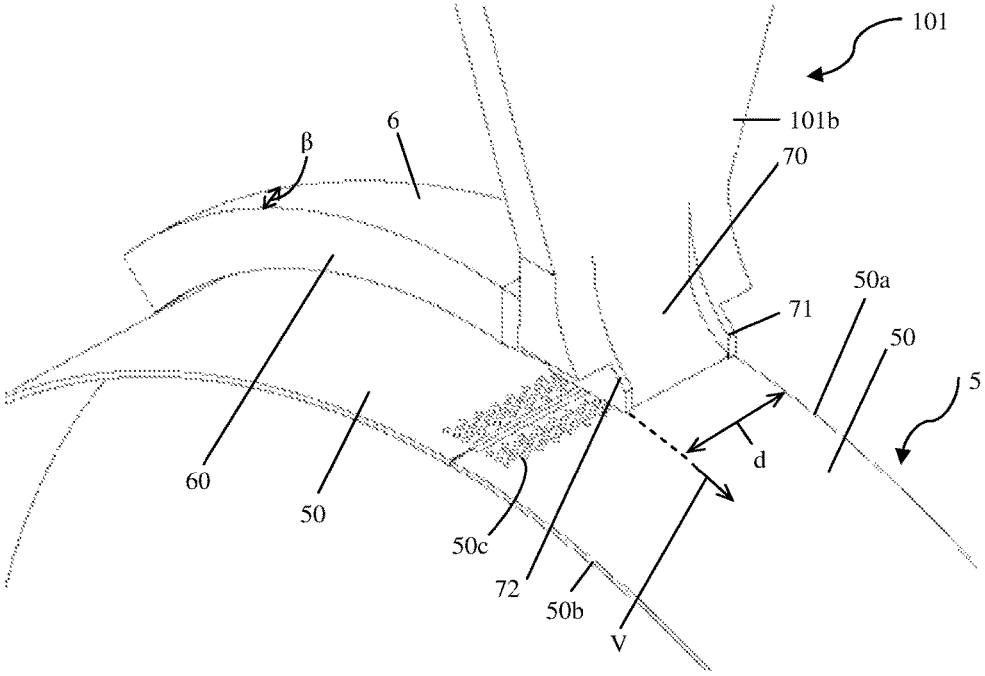
FIG. 5 shows a perspective view of the discharge unit without the covering part and the guide element, together with a part of the lateral surface of a differently designed cooling drum located underneath, in which the yarn plugs are not shown.

The discharge unit (101) consists of a section (101*a*) comprising a surface on which the partition walls between the discharge channels (4),(5),(6) are formed, thus forming converging open channels with a substantially U-shaped profile thereon, and a section (101*b*) having a flat surface. By joining both parts (101*a*),(101*b*) together, in which case the surface comprising the open channels of the one part (101*a*) and the flat surface of the other part (101*b*) are joined together, the channels are closed and a unit (101) comprising internal closed discharge channels (4),(5),(6) is produced. FIGS. 1 and 2 only show the part (101*a*) comprising the open channels (4),(5),(6). FIGS. 4 and 5 only show the part (101*b*) with the flat surface. For the sake of simplicity, the open channels on the one part (101*a*) are denoted by the same reference numerals as the closed texturing channels (4),(5),(6) in FIGS. 1 and 2. These discharge channels are, for example, designed to have a square or rectangular cross section, but obviously other shapes are also possible.

The common discharge channel (7) comprises a curved guiding surface (70) which extends in a substantially vertical direction at the top and curves further down so as to form an end section at the bottom which extends in a direction which more or less corresponds to the direction in which the lateral surface (50), situated underneath, of the cooling drum (5) runs, as can best be seen in FIG. 5. This direction is also the direction (V) in which the lateral surface (50) of the rotating cooling drum (5) is displaced.

The bottom end section of this guiding surface (70) is delimited on both sides by upright channel walls (71),(72) which protrude above the guiding surface (70). In this case, the one channel wall (71) is situated in the vertical plane in which the side edge (51) of the lateral surface (50) is situated. The inner side of the other channel wall (72) faces the side of the guiding surface (70) and the outer side faces the lateral surface (50) and which, as will be explained below, acts as a guide wall to guide the yarn plugs (11),(12),(13) which are starting the second revolution next to the parts which are performing the first revolution.

Via the converging discharge channels (4),(5),(6), the three yarn plugs (11),(12),(13) are moved to the common discharge channel (7) and, from there, they are moved over the guiding surface (70) while bearing against each other until they reach the cylindrical lateral surface (50), situated underneath, of the rotating cooling drum (5) (see FIG. 4) to cool down, thus causing the deformations to set.

Figure 3:
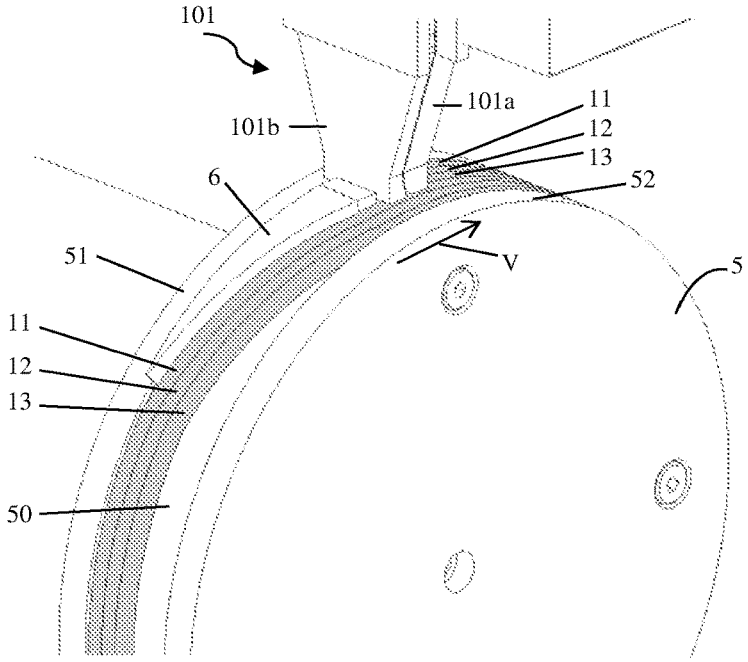
FIG. 3 shows a perspective view of the discharge unit, the guide element and a part of the cooling drum on which three converging yarn plugs perform more than one revolution.

In FIG. 3, the two parts (101*a*),(101*b*) of the discharge unit (101) are combined and the three yarn plugs (11),(12),(13) are shown which have completed one revolution on the lateral surface (50) of the cooling drum (5) and have already started the second revolution. The converging parts of the three yarn plugs (11),(12),(13) which are performing the second revolution are situated next to their converging parts which are performing the first revolution. During each revolution, the yarn plugs (11),(12),(13) are situated next to one another in the same order. All adjacent parts of yarn plugs bear against each other and substantially contact one another.

As has already been mentioned above, the cooling drum (5) is rotated at a speed at which the speed of movement of the lateral surface (50) corresponds to the speed at which the yarn plugs (11),(12),(13) leave the common discharge channel (7). The curved guiding surface (70) is positioned above the lateral surface (50) in such a way that the yarn plugs (11),(12),(13) end up on a zone of the lateral surface (50) which adjoins a side.

The cooling drum (5) illustrated in FIGS. 3 and 4 comprises a lateral surface (50) which is delimited on both sides by lateral edges (51), (52) which protrude above the lateral surface. Here, the yarn plugs of the first revolution are laid on the lateral surface (50) in such a way that they adjoin one of these edges (51),(52). In the figures, this is the left-hand edge (51), viewed in the direction of movement (V) of the yarn plugs (11),(12),(13) below the discharge channel (7). The yarn plugs (11),(12),(13) are lead away from this left-hand edge (51) at the start of the second revolution by a guide element (6) described below.

Figure 6:
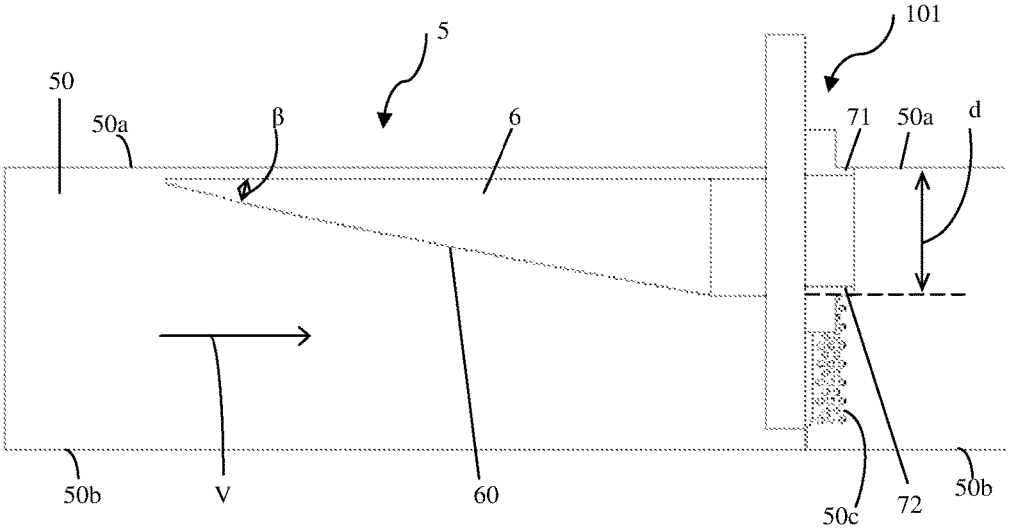
FIG. 6 shows a top view of the parts of the texturing device illustrated in FIG. 5.

In FIGS. 5 and 6, the cooling drum (5) is carried out differently from FIGS. 3 and 4. Here, the lateral surface (50) is not laterally delimited, but continues to the two lateral end edges (50*a*),(50*b*) of the lateral surface (50). Here, the yarn plugs (11),(12),(13) will run along the left-hand end edge (50*a*) of the lateral surface (50) during the first revolution.

The lateral guidance of the yarn plugs (11),(12),(13) starting the second revolution (see FIG. 3) is effected evenly by means of a guide element (6) which is connected to the rear side (the side via which the yarn plugs leave the discharge unit is the front side) of the discharge unit (101), and which has a substantially triangular shape in top view (see FIG. 6) with a substantially vertical guide wall (60) which forms the oblique side of the triangle in the top view.

The guide wall (60) extends obliquely from a location in the vicinity of the left-hand end edge (50*a*) of the lateral surface (50), viewed in the direction of movement (V) of the yarn plugs (11),(12),(13), and runs obliquely in the direction of movement (V) to the right-hand end edge (50*b*) and for the rest adjoins the upright channel wall (72) which delimits the guiding surface (70) of the discharge channel (7) on the right-hand side. The angle (β) which the oblique guide wall (60) makes with respect to a plane which runs parallel to the planes in which the lateral end edges (50*a*), (50*b*) of the lateral surface (50) are situated (see FIG. 6) is approximately 8°.

The yarn plugs (11),(12),(13) which move in the direction of movement (V) are placed close to the left-hand end edge (50*a*) on the lateral surface (50) during the first revolution and will gradually be moved to the right by the fixedly positioned oblique guide wall (60) during their displacement at the end of the first revolution and run along the outer side of the right-hand channel wall (72), so that the three converging yarn plugs (11),(12),(13) are brought to a distance (d) from the left-hand end edge (50*a*). This distance (d) corresponds to the width which the converging yarn plugs (11),(12),(13) occupied during the first revolution from said end edge (50*a*). Thus, the converging yarn plugs (11),(12),(13) in the second revolution end up in a position in which they run next to their converging parts of the first revolution and substantially contact them.

The lateral surface of the cooling drum (5) contains perforations (50*c*) provided for allowing ambient air through which is drawn in by suction means which are not shown in the drawings and are provided in the space below the lateral surface. These perforations (50*c*) are evenly distributed across the entire lateral surface (50). In the FIGS. 5 and 6, these perforations (50*c*) are only shown in a very limited portion of this lateral surface (50).

The invention claimed is:

1. Device for texturing filaments of plastic material in order to form a crimped textile yarn, comprising a texturing unit having at least two texturing channels extending along respective axes which converge in the direction of discharge openings, each of the texturing channels being configured to displace a filament of plastic material in the respective texturing channel to a corresponding one of the discharge openings and to transform the filament of plastic material into a yarn plug in the respective texturing channel.

2. Device for texturing filaments of plastic material according to claim 1, characterized in that the texturing unit comprises at least three texturing channels.

3. Device for texturing filaments of plastic material according to claim 1, characterized in that each texturing channel is of the same length as each other texturing channel.

4. Device for texturing filaments of plastic material according to claim 1, characterized in that the device comprises a movable conveying surface and is configured to place the yarn plugs leaving the texturing channels onto the moving conveying surface, and that the device comprises a discharge channel which is provided to lead the yarn plugs from the texturing channels towards the conveying surface in a converging manner.

5. Device for texturing filaments of plastic material according to claim 4, characterized in that the conveying surface comprises openings and that the device comprises means for creating a stream of air through these openings.

6. Device for texturing filaments of plastic material according to claim 4, characterized in that the device comprises a rotatable cooling drum, and that the conveying surface is a cylindrical lateral surface of the cooling drum.

7. Device for texturing filaments of plastic material according to claim 6, characterized in that the cylindrical lateral surface comprises a smooth and uninterrupted surface so that the converging yarn plugs can be placed on the lateral surface so that they rest against each other and are not separated from each other.

8. Device for texturing filaments of plastic material according to claim 6, characterized in that the device is configured to lead the converging yarn plugs away from the cylindrical lateral surface after the converging yarn plugs have completed at least one entire revolution on the lateral surface.

9. Device for texturing filaments of plastic material according to claim 8, characterized in that the device comprises a guide to place the converging parts of yarn plugs of successive revolutions next to each other on the lateral surface.

10. Device for texturing filaments of plastic material according to claim 4, characterized in that the discharge channel comprises an end section which comprises a guiding surface, the guiding surface being situated above the conveying surface and laterally delimited by at least one channel wall which protrudes above the guiding surface.

11. Device for texturing filaments of plastic material according to claim 9, characterized in that a channel wall of the discharge channel has a side which faces the lateral surface and is provided to guide, at the start of a second revolution, the converging yarn plugs onto the lateral surface next to the parts of the converging yarn plugs which are performing a first revolution.

12. Device for texturing filaments of plastic material according to claim 9, characterized in that the guide comprises a guide element which is situated above the lateral surface, in that the guide element comprises a guide wall which extends obliquely from a location in the vicinity of one side edge of the lateral surface in the direction of another side edge in order to guide, at the start of a second revolution, the converging yarn plugs onto the lateral surface next to the parts of the converging yarn plugs which are performing a first revolution.

13. Device for texturing filaments of plastic material according to claim 1, characterized in that the texturing channels extend along axes between which an angle ($\alpha$) is formed of at least 1°.

14. Device for texturing filaments of plastic material according to claim 8, characterized in that the device is configured to lead the converging yarn plugs away from the cylindrical lateral surface after the converging yarn plugs have completed at least 1.3 revolutions on the lateral surface.

15. Device for texturing filaments of plastic material according to claim 1, characterized in that the texturing channels extend along axes between which an angle ($\alpha$) is formed of at least 4°.

* * * * *